US006855666B2

(12) United States Patent
Simpson et al.

(10) Patent No.: US 6,855,666 B2
(45) Date of Patent: Feb. 15, 2005

(54) TRANSFERABLE UV PROTECTIVE IMAGE OVERCOAT

(75) Inventors: William H. Simpson, Pittsford, NY (US); Jacob J. Hastreiter, Jr., Spencerport, NY (US); Kurt M. Schroeder, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 362 days.

(21) Appl. No.: 10/100,333

(22) Filed: Mar. 18, 2002

(65) Prior Publication Data

US 2003/0176283 A1 Sep. 18, 2003

(51) Int. Cl.[7] ..... B41M 5/035; B41M 5/38

(52) U.S. Cl. ..... 503/227; 428/32.6; 428/32.69; 524/720; 524/721; 544/180

(58) Field of Search ..... 428/32.6, 32.69; 503/227; 524/720, 721; 544/180; 8/471

(56) References Cited

U.S. PATENT DOCUMENTS 6,184,375 B1 2/2001 Huglin ..... 544/116

FOREIGN PATENT DOCUMENTS

EP 0 507 734 10/1992
EP 1177913 A2 2/2002

*Primary Examiner*—Bruce Hess
(74) *Attorney, Agent, or Firm*—Kathleen Neuner Manne; Arthur E. Kluegel

(57) ABSTRACT

Disclosed is a heat transferable protective overcoat comprising a hydroxyphenyl triazine compound in a polymeric binder. Such an overcoat provides UV protection without degrading sunlight protection.

14 Claims, No Drawings

TRANSFERABLE UV PROTECTIVE IMAGE OVERCOAT

FIELD OF THE INVENTION

This invention relates to a heat transferable protective overcoat comprising a hydroxyphenyl triazine compound in a polymeric binder. More particularly, it relates to the use of such an overcoat for a thermal dye sublimation image.

BACKGROUND OF THE INVENTION

In recent years, thermal transfer systems have been developed to obtain prints from pictures that have been generated electronically from a color video camera. According to one way of obtaining such prints, an electronic picture is first subjected to color separation by color filters. The respective color-separated images are then converted into electrical signals. These signals are then operated on to produce cyan, magenta and yellow signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271.

Exposure of dyes to ultraviolet light (light with wavelengths less than 400 nm) usually results in degradation, or fading, of dyes with time. The degradation can be caused by photolysis, which is the direct absorption of the ultraviolet light. The dye can also degrade by either photooxidation or photoreduction depending on the chemical structure of the dye and of the natural or man-made polymer surrounding the dye. It is common to include a UV absorbing material in a heat-transferable protective overcoat layer for a dye-diffusion thermal transfer print as taught in U.S. No. Pat. 4,522,881 to reduce the rate of dye fading from ultraviolet light. Protection of the printed image from UV light should not degrade the stability of the image to daylight, which has a much lower intensity of UV light. Normally, some of the UV absorbing material diffuses into the receiving layer during transfer of the over protective layer. The material can then interact with either the dyes in the receiver layer or the polymers that make up the receiving layer. A negative interaction can cause the dyes to fade more rapidly in the presence of small amounts of the UV absorbing agent than in its absence when exposed to either daylight or sunlight.

U.S. Pat. No. 6,184,375 suggests the use of triazine UV absorbers for a broad range of uses. It is suggested to employ such materials in various locations such as the receiver layer or in the overcoat as described in EP 505,734.

It is a problem to be solved to provide a thermal dye transfer imaging element containing a UV absorber that provides the image improved resistance to degradation from UV light exposure without degrading the resistance of the image to daylight exposure.

SUMMARY OF THE INVENTION

The invention provides a heat transferable protective overcoat comprising a hydroxyphenyl triazine compound in a polymeric binder. The invention also provides a thermal dye sublimation donor element that contains the overcoat, a protected image containing the transferred overcoat, and a process for protecting an image comprising applying such a coating.

The overcoat provides UV protection without degrading daylight protection.

DETAILED DESCRIPTION OF THE INVENTION

The hydroxyphenyl triazine UV absorbers useful in the invention may be generally represented by Formula I. When included in a thermal transferable protective overcoat, such absorbers have been found to be useful for improving the UV resistance of a dye image without degrading the sunlight resistance.

I

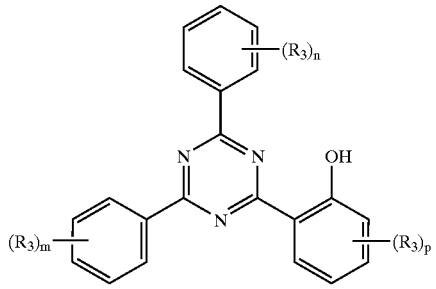

In Formula I, each $R_3$ is a substituent and m, n, and p are each 0 to 3. Suitably, each R subscripted group present is an alkyl, alkoxy, or hydroxy group. Ester containing substituents are useful. U.S. Pat. No. 6,184,375 describes numerous examples of specific useful compounds.

More specific formulas for useful compounds are given by Formulas I' and I" below:

I'

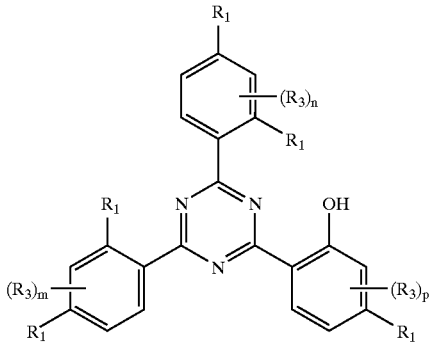

wherein each $R_1$, is a substituent and each $R_3$ is a substituent and m, n, and p are each 0 to 2. Suitably, each R subscripted group present is an alkyl, alkoxy, or hydroxy group.

I″

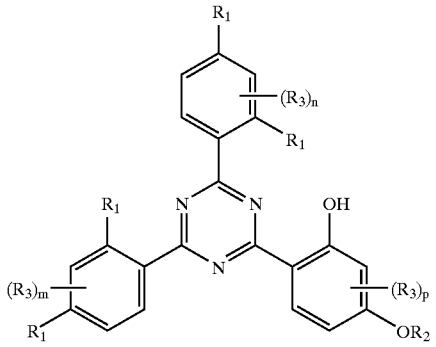

wherein $R_2$ is an alkyl group of up to 8 carbon atoms, each $R_1$ is a substituent, and each $R_3$ is a substituent and m, n, and p are each 0 to 2. Suitably, each $R_1$ and each $R_3$ group present is an alkyl, alkoxy, or hydroxy group.

A particularly useful embodiment is represented by Formula II below:

II

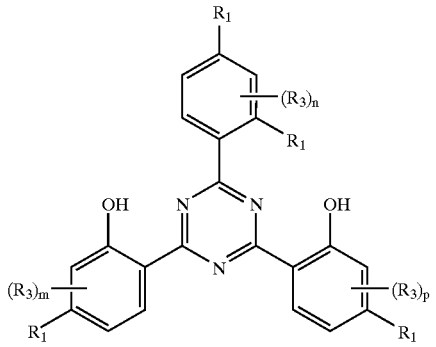

wherein each $R_1$ is a substituent, and each $R_3$ is a substituent and m, n, and p are each 0 to 2. Suitably, each R subscripted group present is an alkyl, alkoxy, or hydroxy group.

Compound Inv II-a and II-b are examples of Formula II in which all $R_1$ groups are hydroxy or n-butoxy groups.

Unless otherwise specifically stated, use of the term "group", "substituted" or "substituent" means any group or radical other than hydrogen. Additionally, when reference is made in this application to a compound or group that contains a substitutable hydrogen, it is also intended to encompass not only the unsubstituted form, but also its form further substituted with any substituent group or groups as herein mentioned, so long as the substituent does not destroy properties necessary for the intended utility. Suitably, a substituent group may be halogen or may be bonded to the remainder of the molecule by an atom of carbon, silicon, oxygen, nitrogen, phosphorous, or sulfur. The substituent may be, for example, halogen, such as chloro, bromo or fluoro; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, cyclohexyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha-or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo- 1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino,p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonaimido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, andp-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfmyl, 4-nonylphenylsulfinyl, andp-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, andp-tolylthio; acyloxy, such as acetyloxy, benzoyloxy, octadecanoyloxy, p-dodecylamidobenzoyloxy, N-phenylcarbamoyloxy, N-ethylcarbaamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired desirable properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided.

Specific examples of useful UV absorbers used herein are:

Inv I-1

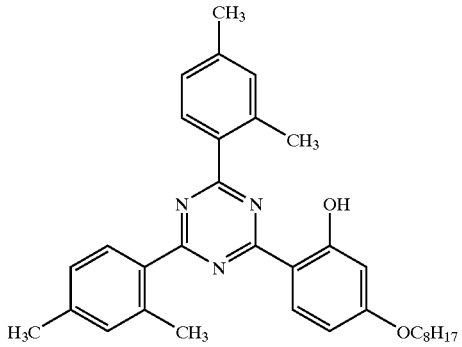

Inv I-2

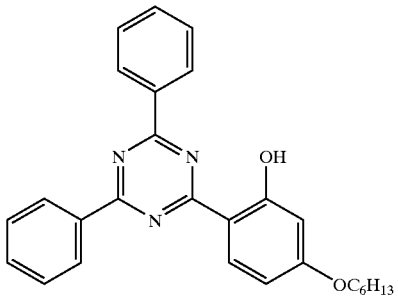

Inv I-3

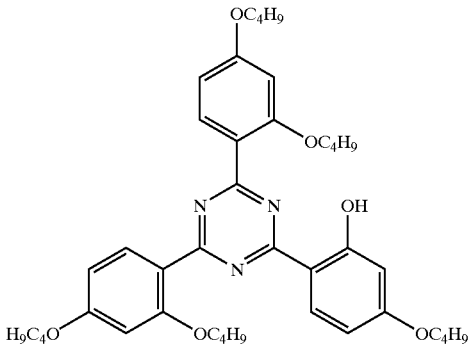

Inv II-a

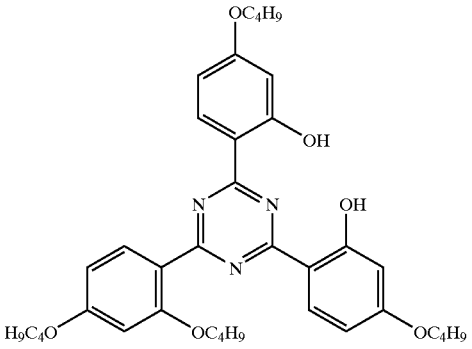

-continued

Inv II-b

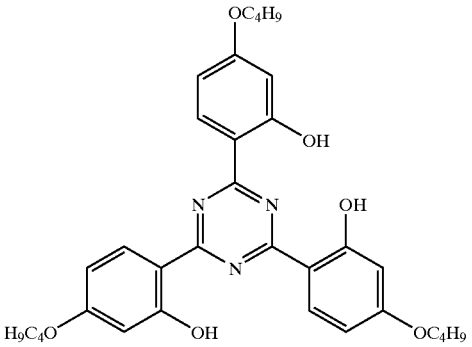

In a preferred embodiment of the invention, the dye-donor element is a multicolor element comprising repeating color patches of yellow, magenta and cyan image dyes, respectively, dispersed in a binder, and a patch containing the protection layer.

In another embodiment of the invention, the protection layer is the only layer on the donor element and is used in conjunction with another dye-donor element which contains the image dyes.

In another preferred embodiment of the invention, the dye-donor element is a monochrome element and comprises repeating units of two areas, the first area comprising a layer of one image dye dispersed in a binder, and the second area comprising the protection layer.

In another preferred embodiment of the invention, the dye-donor element is a black-and-white element and comprises repeating units of two areas, the first area comprising a layer of a mixture of image dyes dispersed in a binder to produce a neutral color, and the second area comprising the protection layer.

The present invention provides a protection overcoat layer on a thermal print by uniform application of heat using a thermal head. After transfer to the thermal print, the protection layer provides superior protection against image deterioration due to exposure to light, common chemicals, such as grease and oil from fingerprints, and plasticizers from film album pages or sleeves made of poly(vinyl chloride). The protection layer is generally applied at a coverage of at least about 0.03 $g/m^2$ to about 1.7 $g/m^2$ to obtain a dried layer of less than 1 $\mu$m.

As noted above, the transferable protection layer comprises the UV absorbing material dissolved in a polymeric binder. Many such polymeric binders have been previously disclosed for use in protection layers. Examples of such binders include those materials disclosed in U.S. Pat. No. 5,332,713, the disclosure of which is hereby incorporated by reference. In a preferred embodiment of the invention, poly(vinyl acetal) is employed.

Inorganic particles are present in the protection layer of the invention. There may be used, for example, silica, titania, alumina, antimony oxide, clays, calcium carbonate, talc, etc. as disclosed in U.S. Pat. No. 5,387,573. In a preferred embodiment of the invention, the inorganic particles are silica. The inorganic particles improve the separation of the laminated part of the protection layer from the unlaminated part upon printing.

In a preferred embodiment of the invention, the protection layer contains from about 5% to about 60% by weight inorganic particles, from about 25% to about 60% by weight polymeric binder and from about 2–30%, typically 5–20% by weight of the UV absorbing compound.

In use, yellow, magenta and cyan dyes are thermally transferred from a dye-donor element to form an image on the dye-receiving sheet. The thermal head is then used to transfer the clear protection layer, from another clear patch on the dye-donor element or from a separate donor element, onto the imaged receiving sheet by uniform application of heat. The clear protection layer adheres to the print and is released from the donor support in the area where heat is applied.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

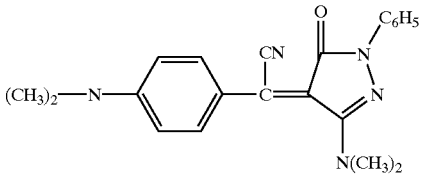

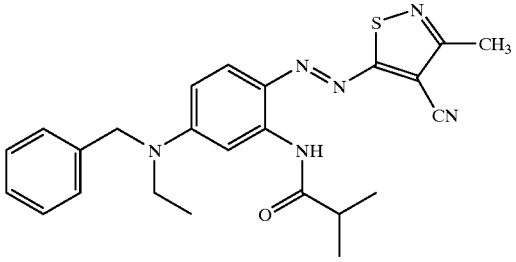

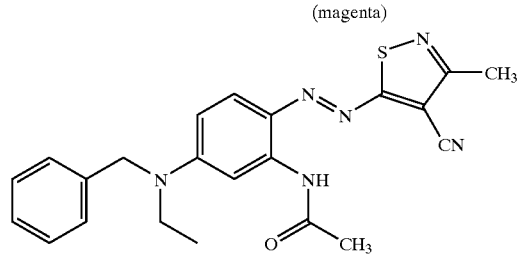

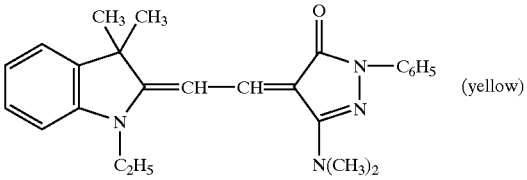

-continued

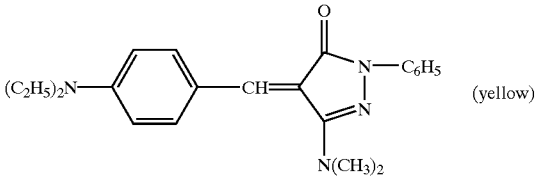

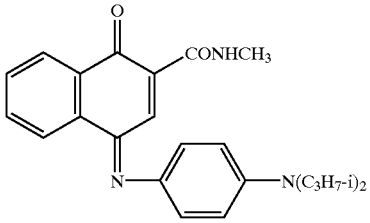

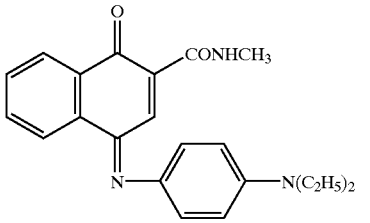

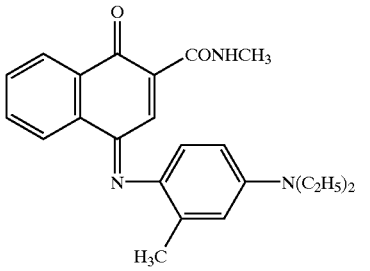

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly (vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads, which can be used to transfer dye from the dye-donor elements of the invention, are available commercially. There can be employed, for example, a Fujitsu Thermal Head FTP-040 MCSOO1, a TDK Thermal Head LV5416 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be pre-assembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

In an embodiment of the invention, the thermal donor element contains a patch of dye to be transferred including a particular type of dye and the protected image reproduction includes a particular type of dye. The dye is selected from merocyanine, methine, azo, and azamethine dyes. In particular, at least one of the color patches contains a methine dye.

In another embodiment, the UV absorbing material comprises one of Formula II wherein not only is the UV dye fade improved, but also the fade rate of the color image dyes is leveled to provide a more acceptable fading result.

EXAMPLE

Control Element C-1

Protection layer donor elements were prepared by coating on the back side of a 6 $\mu$m poly(ethylene terephthalate) support:

1) a subbing layer of titanium alkoxide, Tyzor TBT®, (DuPont Corp.) (0.13 g/m$^2$) from a n-propyl acetate and n-butyl alcohol solvent mixture (85/15), and
2) a slipping layer containing an aminopropyl-dimethyl-terminated polydimethylsiloxane, PS513® (United Chemical Technologies) (0.01 g/m$^2$), apoly(vinyl acetal) binder, KS-1, (Sekisui Co.), (0.38 g/m$^2$), p-toluenesulfonic acid (0.0003 g/m$^2$) and candellila wax (0.02 g/m$^2$) coated from a solvent mixture of 3-pentanone, methanol and distilled water (88.7/9.0/2.3).

On the front side of the element was coated a transferable overcoat layer of poly(vinyl acetal), KS-10, (Sekisui Co.), at a laydown of 0.63 g/m$^2$, colloidal silica, IPA-ST (Nissan Chemical Co.), at a laydown of 0.46 g/m$^2$ and 4 $\mu$m divinylbenzene beads at a laydown of 0.11 g/m$^2$. The materials were coated from the solvent 3-pentanone.

Control Element C-2

This element is the same as C-1 with the addition to the transferable overcoat layer of Comp-1, Tinuvin 328® (Ciba Specialty Chemicals), a UV absorbing benzotriazole, at a laydown of 0.32 g/m$^2$.

Control Element C-3

This element is the same as C-1 with the addition to the transferable protection overcoat layer of Comp-2, Parsol 1789® (Roche Div. of Hoffnan-LaRoche), a UV absorbing dibenzoylmethane, at a laydown of 0.16 g/m$^2$. The materials were coated solvent mixture of 2-butanone and 1-methoxy-2-propanol (74:26).

Control Element C-4

This element is the same as C-1 with the addition to the transferable overcoat layer of Comp-3, PC ADD UVA5® (Nitroil), a UV absorbing formamidine, at a laydown of 0.16 g/m$^2$. The materials were coated from a solvent mixture of 2-butanone and 1-methoxy-2-propanol (74:26).

Inventive Element I-1

This element is the same as C-1 with the addition to the transferable protection overcoat layer of Inv I-1 (Cyasorb UV1164® Cytec Industries), a UV absorbing triazine, at a laydown of 0.08 g/m$^2$. The materials were coated from the solvent 3-pentanone.

Inventive Element I-2

This element is the same as C-1 with the addition to the transferable protection overcoat layer Inv I-1 (Cyasorb UV1164® Cytec Industries), a UV absorbing triazine, at a laydown of 0.16 g/m$^2$. The materials were coated from the solvent 3-pentanone.

Inventive Element I-3

This element is the same as C-1 with the addition to the transferable protection overcoat layer of Inv I-1 (Cyasorb UV1164® Cytec Industries), a UV absorbing triazine, at a laydown of 0.32 g/m$^2$. The materials were coated from the solvent 3-pentanone.

Inventive Element I-4

This element is the same as C-1 with the addition to the transferable protection overcoat layer of Inv I-2, a UV absorbing triazine, at a laydown of 0.08 g/m$^2$. The materials were coated from the solvent 3-pentanone.

Inventive Element I-5

This element is the same as C-1 with the addition to the transferable protection overcoat layer of Inv I-2, a UV absorbing triazine, at a laydown of 0.16 g/m$^2$. The materials were coated from the solvent 3-pentanone.

Inventive Element I-6

This element is the same as C-1 with the addition to the transferable protection overcoat layer of Inv I-2, a UV absorbing triazine, at a laydown of 0.32 g/m$^2$. The materials were coated from the solvent 3-pentanone.

Inventive Element I-7

This element was prepared the same as Control Element C-1 with the addition of Inv II-1, a UV absorbing triazine containing a mixture of UV compounds I-3, II-a, and II-b, (0.5/97.5/2.0 wt % )at a laydown of 0.08 g/m$^2$. The materials were coated from the solvent 3-pentanone.

Inventive Element I-8

This element was prepared the same as Control Element C-1 with the addition of Inv II-1, a UV absorbing triazine, at a laydown of 0.16 g/m$^2$. The materials were coated from the solvent 3-pentanone.

Inventive Element I-9

This element was prepared the same as Control Element C-1 with the addition of Inv II-1, a UV absorbing triazine, at a laydown of 0.32 g/m$^2$. The materials were coated from the solvent 3-pentanone.

Inventive Element I-10

This element was prepared the same as Control Element C-1 with the addition of Inv II-1, a UV absorbing triazine, at a laydown of 0.16 g/m$^2$ coated from a solvent mixture of 2-butanone and 1-methoxy-2-propanol (74:26).

Printing

Using Kodak Professional EKTATHERM XLS XTRALIFE Color Ribbon (Eastman Kodak Co. Catalog No. 807-6135) and a Kodak Model 8650 Thermal Printer, a cyan, a magenta and a yellow image each having a Status A red, green or blue density, respectively, of approximately 1.0 (±0.05) was printed on Kodak Print Paper (Eastman Kodak Co. Catalog No. 172-5514). The color ribbon-receiver assemblage was positioned on an 18 mm platen roller and a TDK thermal head (No. 9D1001) with a head load of 6.35 Kg was pressed against the platen roller. The TDK 9D1001 thermal print head has 2560 independently addressable heaters with a resolution of 300 dots/inch and an average resistance of 3243Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 54 μsec every 71 μsec. Printing maximum density required 64 pulses "on" time per printed line of 5.0 msec. The voltage supplied was 13.5 volts and the maximum total energy required to print Dmax density for the yellow, magenta and cyan dye was 0.246 mJ/dot, 0.239 mJ/dot and 0.253 mJ/dot, respectively.

Each of the protective layer elements described above was placed in contact with the polymeric receiving layer side of the receiver element containing the cyan image described above. The printing process was used to heat the transferable protection overcoat uniformly with the thermal head to permanently adhere the transferable protection overcoat to the print. The heat transferable over-protective layer was applied to the image using an instantaneous peak power of $42.5\times10^{-3}$ Watt/dot and apeak energy of 0.158 mJ/dot. The donor support was peeled away as the printer advanced through its heating cycle, leaving the transferable protection overcoat adhered to the imaged receiver.

Image Stability Testing

Following application of the transferable protection overcoat the yellow, magenta and cyan dye image densities were measured using a Status A blue, green and red filter, respectively, with an X-rite Model 820 Reflection Densitometer.

The prepared samples were then subjected to a simulated daylight exposure using a xenon lamp with a soda-lime glass filter giving an exposure of 50 Klux for a duration of two weeks. Upon removal from the simulated daylight exposure the materials were reread for Status A Reflection density.

The result of the simulated daylight testing is shown in Table 1 for the yellow dye image.

TABLE 1

| Transferable protective overcoat element | Name of UV Absorbing Compound | Class of UV Absorbing Material | Percent Change in Density After Two Weeks Simulated Daylight |
|---|---|---|---|
| C-1 | none present | none present | −7 |
| C-2 | Comp-1 | benzotriazole | −7 |
| C-3 | Comp-2 | dibenzoyl-methane | −35 |
| C-4 | Comp-3 | formamidine | −11 |
| I-9 | Inv II-1* | triazine | −7 |
| I-10 | Inv II-1 | triazine | −7 |

*Mixture of I-3, II-a and II-b

The results in Table 1 show that under simulated daylight exposure the fade of the yellow dye tested was actually accelerated with the incorporation of either the dibenzoylmethane or the formamidine UV absorber. Neither the benzotriazole C-2 nor Inv II-1 showed accelerated degradation of the yellow dye.

The results for the simulated daylight testing is shown in Table 2 for the magenta dye image.

TABLE 2

| Transferable protective overcoat element | Name of UV Absorbing Compound | Class of UV Absorbing Material | Percent Change in Density After Two Weeks Simulated Daylight |
|---|---|---|---|
| C-1 | none present | none present | −11 |
| C-2 | Comp-1 | benzotriazole | −10 |
| C-3 | Comp-2 | dibenzoyl-methane | −31 |
| C-4 | Comp-3 | formamidine | −22 |
| I-9 | Inv II-1 | triazine | −10 |
| I-10 | Inv II-1 | triazine | −9 |

The results in Table 2 show that under simulated daylight exposure the fade of the magenta dye is accelerated with the incorporation of either the dibenzoylmethane or formamidine UV absorber. Neither the Comp-1 nor the Inv II-1 showed accelerated degradation of the magenta dye.

The result of the simulated daylight testing is shown in Table 3 for the cyan dye image.

TABLE 3

| Transferable protective overcoat element | Name of UV Absorbing Compound | Class of UV Absorbing Material | Percent Change in Density After Two Weeks Simulated Daylight |
|---|---|---|---|
| C-1 | none present | none present | 8 |
| C-2 | Comp-1 | benzotriazole | 11 |
| C-3 | Comp-2 | dibenzoyl-methane | 51 |
| C-4 | Comp-3 | formamidine | 36 |
| I-9 | Inv I-1 | triazine | 8 |
| I-10 | Inv II-1 | triazine | 7 |

The results in Table 3 show that under simulated daylight exposure the fade of the cyan dye is accelerated with the incorporation of the benzotriazole, dibenzoylmethane or formamidine UV absorbers. The elements with Inv II-1, the UV absorbing triazine, showed no accelerated degradation of the cyan dye.

Similarly, another set of samples were printed and the heat transferable over-protective layer was applied as described above to achieve a neutral image having a Status A reflection red, green and blue density of approximately 1.0. The samples were subjected to simulated sunshine exposure using an unfiltered xenon lamp giving an exposure of 50 Klux for a duration of two weeks. Upon removal from the simulated sunshine exposure, the materials were reread for Status A Reflection red, green and blue density. Percent changes in density were then calculated. Preferably, when fading occurs it should be equally proportional for all dyes such that the color balance remains unchanged. To determine the shift from a neutral image one may independently subtract the percent change of the yellow and magenta dyes from the change in cyan dye. If percent cyan change minus percent yellow change (% cyan−% yellow) and cyan change minus percent magenta change (% cyan−% magenta) are both equal to zero (0) then the image, although faded, would remain neutral in appearance.

The results of the neutral fade comparison are shown in Table 4.

TABLE 4

| Transferable protective overcoat element | Name of UV Absorbing Compound | Coating Laydown ($g/m^2$) | Percent Change in Fade After Two Weeks Simulated Sunshine: % Cyan - % Yellow | Percent Change in Fade After Two Weeks Simulated Sunshine: % Cyan - % Magenta |
|---|---|---|---|---|
| C-1 | none present | 0.00 | 33 | 33 |
| I-1 | Inv I-1 | 0.08 | 25 | 24 |
| I-2 | Inv I-1 | 0.16 | 23 | 21 |
| I-3 | Inv I-1 | 0.32 | 22 | 20 |
| I-4 | Inv I-2 | 0.08 | 28 | 28 |
| I-5 | Inv I-2 | 0.16 | 29 | 29 |
| I-6 | Inv I-2 | 0.32 | 26 | 26 |
| I-7 | Inv II-1 | 0.08 | 22 | 23 |
| I-8 | Inv II-1 | 0.16 | 15 | 16 |
| I-9 | Inv II-1 | 0.32 | 13 | 14 |

The results in Table 4 show that the difference, in percent change of cyan and yellow (% Cyan−% Yellow) and percent change of cyan and magenta (% Cyan−% Magenta) are improved by the incorporation of a triazine into the heat transferable overcoat layer. Additionally, Table 4 shows that at an equivalent coating laydown the Inv II-1, UV absorbing triazine, is superior to the other UV absorbing triazines in preventing unbalanced fade.

Comparison Example

A sample was prepared like element I-1 except the UV material was incorporated in the Cyan donor patch rather than the protective overcoat. Inclusion of the UV absorber in the image layer rather than in the protective layer provided no UV protection over unprotected element C-1.

The entire contents of the patents and other publications referred to in this specification are incorporated herein by reference.

What is claimed is:

1. A heat transferable protective overcoat comprising a hydroxyphenyl triazine compound in a polymeric binder, wherein the hydroxyphenyl triazine compound comprises a mixture of structures of the following Formulas:

I

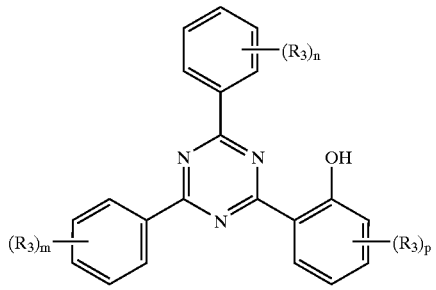

wherein for Formula I each $R^3$ is a substituent, and m, n, and p are each 0 to 3;

I"

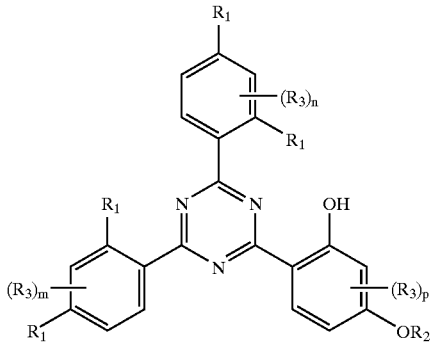

wherein for Formula I" each $R_2$ is an alkyl group of up to 8 carbon atoms, each $R_1$ is a substituent, each $R_3$ is a substituent, and m, n, and p are each 0 to 2; and

II

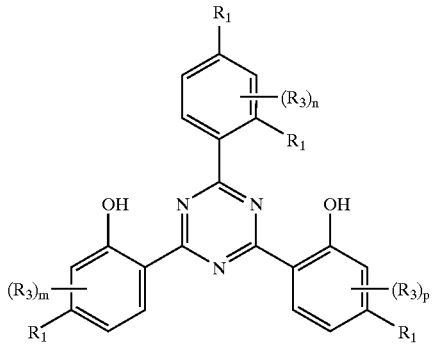

wherein for Formula II each $R_1$ is a substituent, each $R_3$ is a substituent, and m, n, and p are each 0 to 2.

2. The overcoat of claim 1 wherein the hydroxyphenyl triazine compound is present in an amount of 2–30 wt % of the overcoat.

3. A thermal dye sublimation donor element comprising the overcoat of claim 1.

4. The overcoat of claim 1 wherein each $R_1$ and each $R_3$ group present is an alkyl, alkoxy, or hydroxy group.

5. A protected image comprising an image and the transferred overcoat of claim 6 on the image.

6. The overcoat of claim 1 wherein at least one $R_1$ or $R_3$ is an ester group.

7. A protected image comprising an image and the transferred overcoat of claim 6 on the image.

8. A protected image reproduction comprising an image and the transferred overcoat of claim 1 on the image.

9. The protected image of claim 8 comprising a dye selected from the group consisting of methine, azamethine, merocyanine, and azo dyes.

10. The protected image of claim 9 comprising a methine dye.

11. A thermal dye sublimation image comprising an image on a substrate and the overcoat of claim 1 on the image.

12. A process for protecting an image from UV radiation without degrading the protection from daylight exposure comprising applying a thermally transferable overcoat of claim 1 to the image.

13. The overcoat of claim 1 additionally containing solid particles.

14. The overcoat of claim 13 wherein the solid particles are polymeric beads.

* * * * *

UNITED STATES PATENT AND TRADEMARK OFFICE

CERTIFICATE OF CORRECTION

PATENT NO. : 6,855,666 B2
DATED : February 15, 2005
INVENTOR(S) : William H. Simpson et al.

It is certified that error appears in the above-identified patent and that said Letters Patent is hereby corrected as shown below:

Column 14,
Line 65, delete "$R^3$" and replace with -- $R_3$ --.

Column 16,
Line 10, delete "claim 6" and replace with -- claim 4 --.

Signed and Sealed this

Twenty-second Day of November, 2005

JON W. DUDAS
*Director of the United States Patent and Trademark Office*